US006428179B1

(12) United States Patent
Saffron et al.

(10) Patent No.: US 6,428,179 B1
(45) Date of Patent: Aug. 6, 2002

(54) ILLUMINABLE WRITING INSTRUMENT

(76) Inventors: David M. Saffron, 2106 Mt. Olympus Dr., Los Angeles, CA (US) 90048; Jack Saffron, 1030 S. Wooster Ave., #1, Los Angeles, CA (US) 90035

( * ) Notice: Subject to any disclaimer, the term of this patent is extended or adjusted under 35 U.S.C. 154(b) by 0 days.

(21) Appl. No.: 09/436,621

(22) Filed: Nov. 9, 1999

(51) Int. Cl.[7] ..... B43R 29/10

(52) U.S. Cl. ..... 362/118; 362/806; 362/202; 362/203; 362/205; 362/119; 362/394; 401/195

(58) Field of Search ..... 362/118, 806, 362/394, 276, 802, 119, 116, 120, 202, 203, 205; 401/195; 315/200 A; 340/321, 331

(56) References Cited

U.S. PATENT DOCUMENTS

| | | | | | |
|---|---|---|---|---|---|
| 4,518,274 | A | | 5/1985 | Hanggi | |
| 5,210,525 | A | * | 5/1993 | Lennon et al. | 362/116 |
| 5,251,112 | A | | 10/1993 | Chen | |
| 5,405,208 | A | | 4/1995 | Hsieh | |
| 5,446,633 | A | * | 8/1995 | Hanggi | 362/118 |
| 5,544,967 | A | * | 8/1996 | Yao | 362/118 |
| 5,570,967 | A | | 11/1996 | Chen | |
| 5,673,996 | A | | 10/1997 | Ducker | |
| 5,735,592 | A | * | 4/1998 | Shu | 362/118 |
| 5,803,583 | A | | 9/1998 | Hsieh | |
| 5,921,661 | A | * | 7/1999 | Eusterbock et al. | 362/276 |
| 6,158,872 | A | * | 12/2000 | Rodgers | 362/156 |

* cited by examiner

*Primary Examiner*—Sandra O'Shea
*Assistant Examiner*—Anabel Ton
(74) *Attorney, Agent, or Firm*—Martin & Ferraro, LLP

(57) ABSTRACT

An illuminable accessory item having an illuminating unit included within the structure of the accessory item so that the illuminating unit is illuminated upon exertion of pressure on a specific trigger point on the accessory item. A pressure-activated actuator that controls the illumination of the illuminating unit is activated when pressure is applied to the trigger point. The actuator comprises a circuit board that, in combination with the illuminating unit, a trigger and one or more power sources, forms a closed circuit that delivers electrical current to the illuminating unit. One or more embodiments of the invention further include an ornamental fixture that is preferably transparent or translucent and can be used as a cover for the illuminating unit. When the illuminating unit is lit, its illumination is visible through the transparent or translucent portions of the ornamental fixture. A spring-motivated mechanism may be used to slidably control the movement of a writing unit disposed within the structure of the accessory item in a predetermined protracted or retracted position.

20 Claims, 4 Drawing Sheets

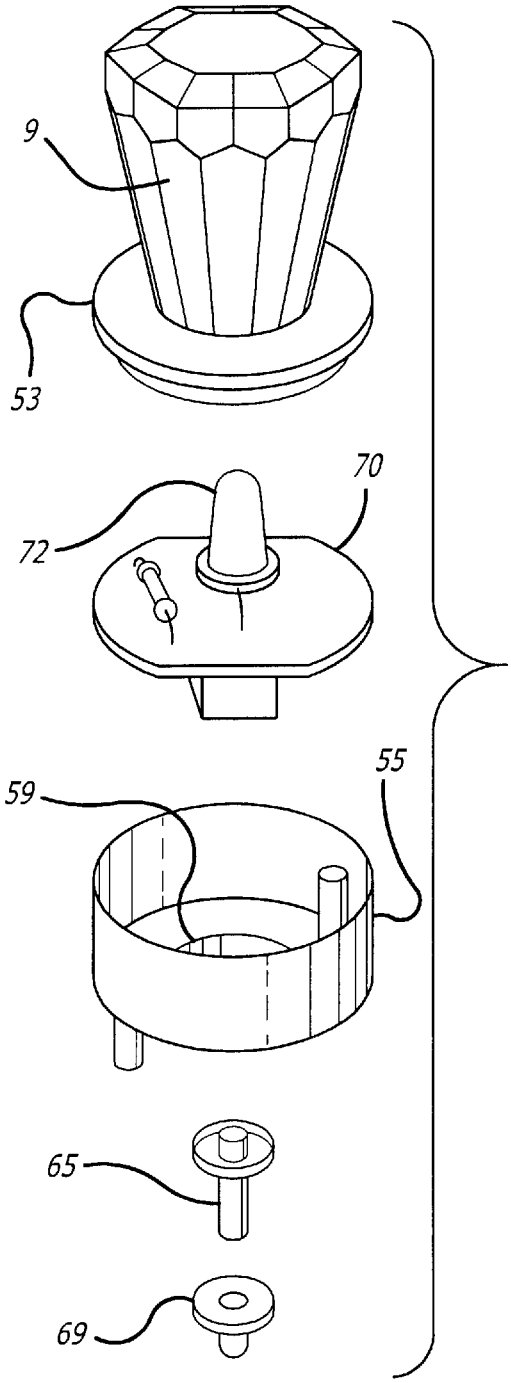
FIG. 5
FIG. 6
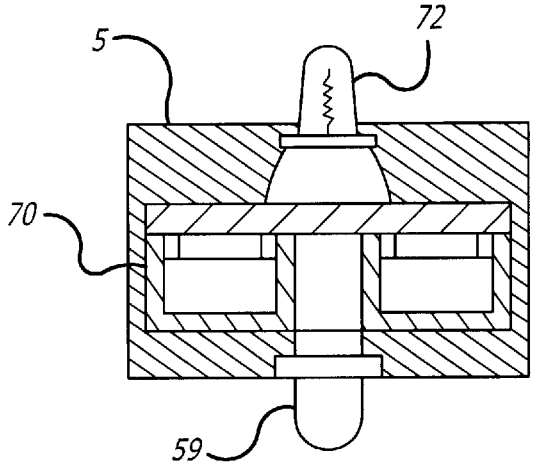

+
-
730
750
790
770
710
700

ILLUMINABLE WRITING INSTRUMENT

BACKGROUND OF THE INVENTION

1. Field of the Invention

The invention generally relates to illuminable accessory items and, more particularly, to a writing instrument that includes an illuminable fixture.

2. Description of the Related Art

It has become common practice to give away or sell engraved or ornamentally designed accessory items, such as pens, pencils, key chains or other frequently used items, to the general public to promote certain names, products or services. However, because this advertising scheme has become so prevalent, typically, a simple engraving or design no longer sufficiently holds or attracts the attention of a user to the specific promotional content intended for the user.

The relative dullness associated with such promotional material can be overcome by addition of interesting features or fixtures to further attract the attention of the user to the product. A user's attention or interest in a common instrument can be even further enhanced if the user can somehow interact with that instrument through the use of a specially added feature or gimmick. For example, lighted or illuminable features can typically provoke a certain amount of excitement and fascination among ordinary users.

Illuminable features have been incorporated into writing instruments, such as writing pens, in the past. However, most prior art devices that have utilized illuminating mechanisms have been directed towards a writing instrument designed for writing in the dark. In the prior art devices, the generated illumination is utilized not as a means for entertainment, but as a means to illuminate a writing space. Hence, the prior art writing instruments that include light emitting means are, typically, more complex in their structural design and therefore more expensive to manufacture in comparison to an ordinary writing instrument, or one that can be cost-effectively fabricated as a promotional item. Thus, there is a need for a writing instrument with illuminable features that can attract the attention of a user and can be cost-effectively produced.

SUMMARY OF THE PREFERRED EMBODIMENT

This invention is directed to an illuminable writing instrument, key chain, and other similar items, that can be distributed as promotional material. According to one or more embodiments of the invention, an illuminating unit can be attached or included within the structure of an accessory item so that the illuminating unit is illuminated upon exertion of pressure to a specific trigger point on the accessory item.

An illuminable writing instrument, according to the present invention, includes an elongated tubular body, an illuminating unit attached to the rear end of the writing instrument, and a pressure-activated actuator that controls the illumination of the illuminating unit. The illuminable writing instrument of the present invention is adapted for housing a writing unit so that the tip of the writing unit can protrude through an opening formed in the front portion of the instrument's body.

In one or more embodiments of the invention, the actuator is activated when pressure is applied to the rear end of the writing unit. The actuator comprises a circuit board that in combination with the illuminating unit, a trigger and one or more power sources can form a closed circuit that delivers electrical current to the illuminating unit. The actuator can be configured to control the illumination of the illuminating unit in various on or off patterns, for example.

One or more embodiments of the invention further include an ornamental fixture that is preferably transparent or translucent and can be used as a cover for the illuminating unit. When the illuminating unit is lit, its illumination is visible through the transparent or translucent portions of the ornamental fixture. For example, the ornamental fixture can be in the shape of a skull where the eyes and the mouth of the skull-shaped fixture are transparent. As such, when the illuminating unit is lit, the resulting illumination emanates through the eyes and mouth of the skull. Embodiments of the invention are adapted to house a writing unit within the body of the writing instrument such that it can slidably move in one or more directions along the elongated tubular body of the instrument. One or more embodiments of the invention include a spring-motivated mechanism used to bias the tip of the writing unit in a direction away from the writing instrument's front opening and means to slidably control the movement of the writing unit in a predetermined protracted or retracted position.

BRIEF DESCRIPTION OF THE DRAWINGS

FIG. 5 is an exploded view of an illuminating mechanism adapted for use with a key chain unit, according to one or more embodiments of the invention.

FIG. 6 is a cross-sectional view illustrating the components of an illuminating mechanism, according to one or more embodiments of the invention.

DETAILED DESCRIPTION OF THE PREFERRED EMBODIMENTS OF THE INVENTION

Figure 1:
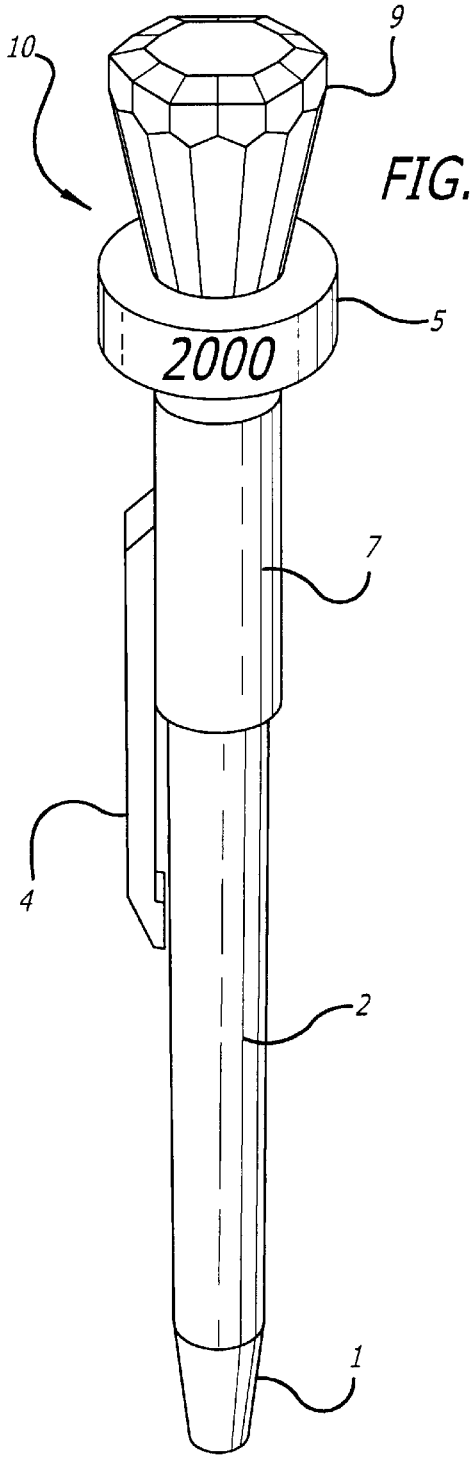
FIG. 1 is a perspective view of an illuminable retractable writing instrument with the writing unit in a retracted position, according to one or more embodiments of the invention.

An illuminable writing instrument in accordance with the present invention is comprised of an illuminating unit electrically connected to a pressure-activated actuator unit housed within the body of the writing instrument. The actuator unit includes an integrated circuit that controls the pattern and duration of illumination of the illuminating unit. Exertion of pressure, for example, on the rear end of the writing instrument causes a trigger to activate the actuator unit and thereby results in the illumination of the illuminating unit for a predetermined length of time.

In one or more embodiments of the invention, the actuator unit is fit into a housing that preferably has a transparent or translucent cover at one end. The actuator housing includes a tubular, elongated sleeve at the other end, adapted for insertion into the rear end of the writing instrument's body, enabling the actuator housing to easily glide forwards and backwards with respect to the body of the writing instrument. The actuator housing acts as a push button and axially corresponds, via a number of elongated intermediate means, with the rear end of a writing unit slidably mounted within the body of the writing instrument. The tubular, elongated sleeve is further configured to receive the trigger within its hollow body and includes accessing means, such as a through opening, that allows the trigger to contact the actuator mechanism through the accessing means when pressure is applied to the end of the writing instrument.

In one or more embodiments of the invention, when pressure is exerted on the rear end of the writing instrument where the actuator housing is located, the actuator housing along with the tubular, elongated sleeve are axially and slidably displaced forwardly into the body of the writing instrument. This displacement causes the actuator unit to move towards the trigger that is housed within the tubular, elongated sleeve. If sufficient pressure is applied, the upper end of the trigger comes in contact with the bottom of the actuator mechanism through the accessing means provided at the bottom of the actuator housing. The trigger includes an electrically conductive layer, such as a magnetic carbon layer, that activates the actuator unit upon contact with a conductive plate that is attached to the bottom of the actuator unit. The activation of the actuator unit hence results in the illumination of the illuminating unit.

In one or more embodiments of the invention, the writing instrument is equipped with a retract-protract mechanism for retracting or protracting the writing unit slidably mounted within the body of the instrument. The retract-protract mechanism is spring-motivated and is in operational relationship with the writing unit, which in turn is in operational relationship with the actuator housing that acts as a push button. Due to this engagement, downward pressure applied to the end of the writing instrument is ultimately transferred to the writing unit and results in the axial displacement of the writing unit into either a retracted or protracted position. Thus, in embodiments of the invention, exertion of pressure to the end of the writing instrument, in addition to causing the illumination of the illuminating unit, also results in the displacement of the writing unit into a predetermined protracted or retracted position.

FIG. 1 is a perspective view of illuminable writing instrument 10, according to one or more embodiments of the invention. Writing instrument 10, in a preferred embodiment, includes head member 1, lower tubular member 2, upper tubular member 7, actuator housing 5 having an elongated tubular sleeve 50 (not shown in FIG. 1), ornamental cover 9, and clip 4. As illustrated in FIG. 1, head member 1, lower tubular member 2, and upper tubular member 7 are connected together along a main elongated axis to form the elongated body of writing instrument 10. A known writing unit, such as a pen cartridge, can be slidably mounted within the elongated body of writing instrument 10.

Figures 3, 4:
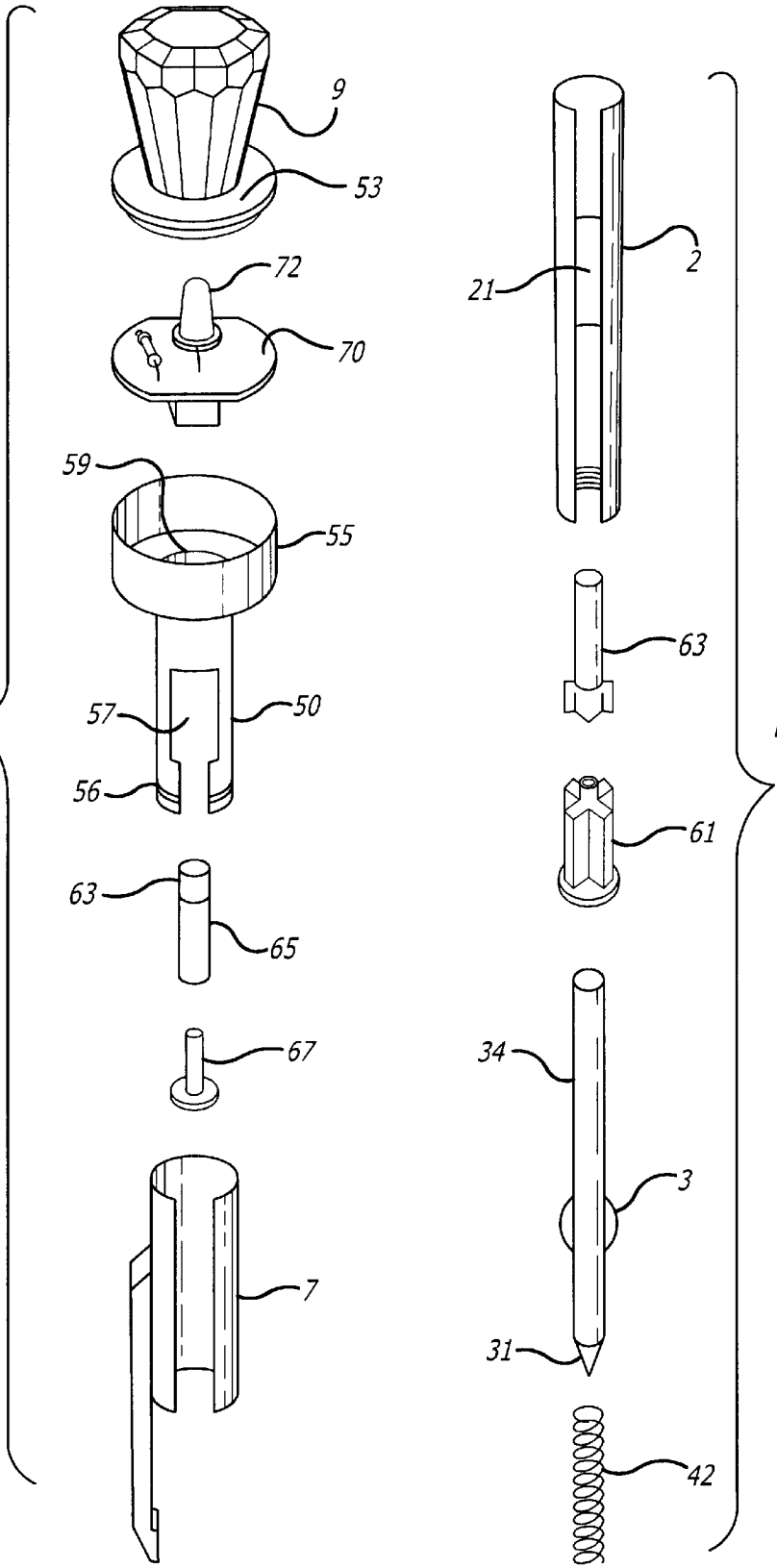
FIG. 3 is an exploded view of the protract-retract mechanism of the illuminable writing instrument of FIG. 1.
FIG. 4 is an exploded view of the illuminating mechanism of the illuminable writing instrument of FIG. 1.

Head member 1 is tapered at one end and has an opening at that end to receive the tip of a writing unit. On the opposite end, head member 1 has an externally threaded opening to threadedly engage lower tubular member 2. As illustrated in FIG. 3, lower tubular member 2 has first and second opposite ends with an opening at each end. The first end is internally threaded for engaging the externally threaded end of head member 1. The second end has an interior diameter that fitly engages the exterior surface of elongated tubular sleeve 50 that extends downwardly from the bottom segment of actuator housing 5, as illustrated in FIG. 4. The second end of lower tubular member 2 also has an exterior diameter that fitly engages the interior surface of upper tubular member 7.

FIG. 4 is an exploded view of the illuminating mechanism, according to an embodiment of the invention. Actuator housing 5 includes top portion 53 and bottom portion 55. Bottom portion 55 is sized to fit actuator unit 70 and has a central opening 59 coaxially interconnected with tubular, elongated sleeve 50. Opening 59 provides means for trigger 65 to contact the lower end of actuator unit 70. Top portion 53 fitly engages bottom portion 55 to enclose actuator 70 therein.

Referring to FIGS. 1 and 4, top portion 53 includes an opening for receiving the lower end of ornamental cover 9. In one or more embodiments of the invention, ornamental cover 9 is hollow and is adapted to be mounted in the opening on the top of actuator housing 5. Additionally, the opening is adapted to allow for illuminating unit 72 attached to the top end of actuator 70, to protrude through, such that the illuminating end of illuminating unit 72 is disposed within ornamental cover 9. Ornamental cover 9 can have various shapes and designs. For example, it can be formed to resemble a diamond, a star, or a skull, with transparent or translucent parts. When illuminating unit 72 is lit, the resulting illumination emanates through the transparent or translucent parts of ornamental cover 9.

Figure 2:
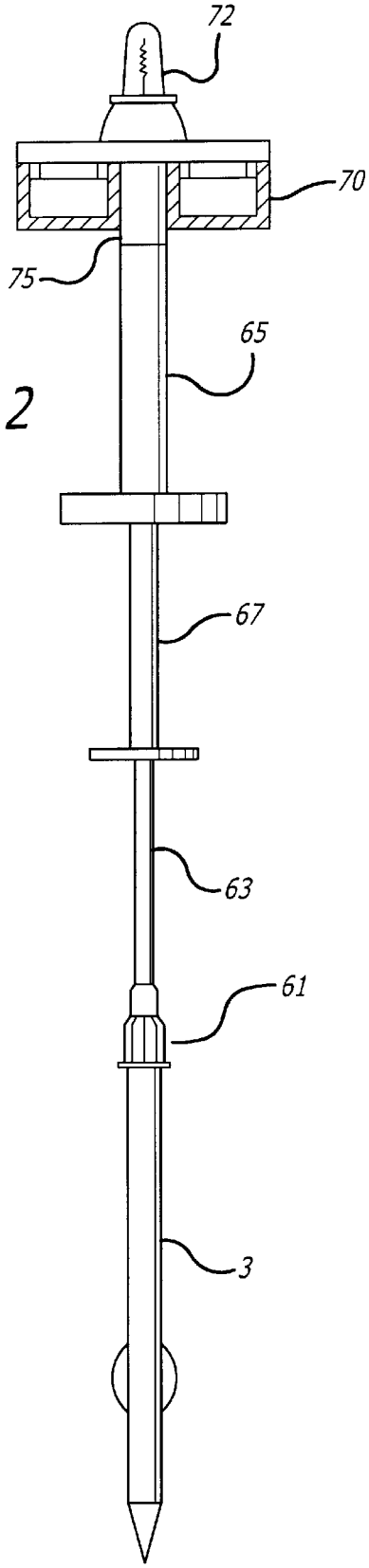
FIG. 2 is an elevational view, partly in cross-section, of some of the inner components of the retractable illuminable writing instrument of FIG. 1.

FIG. 2 is an assembled, cross-sectional view of the inner components of illuminable writing instrument 10, according to an embodiment of the invention. The inner components of writing instrument 10 include writing unit 3, lug member 61, elongated toothed stem 63, seat 67, trigger 65, actuator unit 70, and illuminating unit 72. As illustrated in FIG. 2, all the above components are assembled along a main elongated axis parallel to the central writing instrument 10's central axis, such that they are fitly disposed within the body of writing instrument 10.

FIG. 3 is an exploded view illustrating the protract-retract mechanism of the illuminable writing instrument, according to an embodiment of the invention. Spring 42 is biased so as to urge writing unit 3 towards a retracted position, such that writing tip 31 is concealed within the body of writing instrument 10. Referring to FIGS. 2 and 3, in one or more embodiments of the invention, writing unit 3 includes writing tip 31 at one end and ink repository 34 at the other end. Ink repository 34 has a terminal end opposed to the end attached to writing tip 31. The terminal end of ink repository 34 is loosely engaged with rotatable lug member 61.

Lug member 61 has a female receptacle in one end for receiving the terminal end of ink repository 34. Lug member 61 includes on the opposite end a short cylindrical plug and grooves for engaging elongated toothed stem 63. One or more lugs formed on the outer periphery of lug member 61 are adapted to engage cam slots 21 formed on the interior surface of lower tubular member 2. Cam slots 21 include sequential grooves that are deep or shallow in a longitudinal direction, such that the deep grooves correspond to a retracted position and the shallow grooves correspond to a protracted position of writing unit 3.

Elongated toothed stem 63, at one end, preferably has a cylindrical-shaped base with one or more teeth and a central cavity adapted to loosely engage the cylindrical plug and grooves of rotatable lug member 61. On the opposite end, elongated toothed stem 63 has a terminal end adapted to engage seat 67. Seat 67 is preferably pin-shaped with a wide disk-shaped member at the end that engages elongated toothed stem 63. The disk-shaped end has a front and a back surface. The front surface of the disk is configured to flatly engage the terminal end of elongated toothed stem 63. The back surface of the disk is configured to engage an annular ridge 56 formed on the lower interior surface of tubular, elongated sleeve 50. As illustrated in FIG. 2, in a retracted position, writing unit 3, lug member 61, elongated toothed stem 63, seat 67 and tubular elongated sleeve 50 are in operational relationship with one another, such that if one of them is axially displaced with respect to the tubular body of writing instrument 10, then all the others are also axially displaced along the tubular body of writing instrument 10.

Referring to FIGS. 2 and 4, trigger 65 preferably has a cylindrical body configured to slidably move within elongated tubular sleeve 50. Trigger 65, at one end, has two prongs extending in opposite directions from one another in a plane approximately perpendicular to the body of trigger 65. Trigger 65, in one or more embodiments of the invention, may have only one or more than two prongs, for example. In a preferred embodiment of the invention, however, lug member 61 has two prongs that loosely protrude through vertical grooves 57 formed in tubular, elongated sleeve 50, when trigger 65 is slidably inserted into tubular elongated sleeve 50. Vertical grooves 57 guide the movement of trigger 65 within the tubular body of elongated sleeve 50 and allow for trigger 65's prongs to frictionally engage the interior surface of upper tubular member 7. As illustrated in FIG. 4, vertical grooves 57 are narrower in width at the lower end in order to prevent trigger 65's prongs from sliding all the way out of the elongated sleeve 50.

In assembly, the upper end of lower tubular member 2 is slidably locked between the exterior surface of tubular, elongated sleeve 50 and the interior surface of upper tubular member 7. The upper end of lower tubular member 2 engages the two prongs of trigger 65 that are extended through vertical grooves 57 into the space between the interior surface of upper tubular member 7 and the exterior surface of elongated, tubular sleeve 50. This engagement allows trigger 65 to slidably move along the interior surface of tubular, elongated sleeve 50, as limited by vertical grooves 57, when tubular, elongated sleeve 50 moves slidably within the interior surface of lower tubular member 2. At the end opposite to the prongs, trigger 65 has a conductive medium, such as a magnetic carbon layer 63, adapted to contact conductive plate 75 of actuator unit 70 through accessing means 59. Accessing means 59 is preferably a through opening formed at the bottom of actuator housing 5 and consistently extends through the interior of tubular, elongated sleeve 50.

As illustrated in FIG. 3, in a retracted position, biasing spring 42 urges writing unit 3 toward the rear of writing instrument 10. Due to the operational relationship between writing unit 3 and lug member 61, axial pressure applied to writing unit 3 by spring 42 is directly transferred to lug member 61. Consequently, lugs disposed on the outer periphery of lug member 61 are longitudinally displaceable in one or more cam slots 21, and lug member 61 is urged against elongated toothed stem 63 teeth.

In a retracted position, the axial pressure exerted by spring 42, is transferred to elongated toothed stem 63 and therefrom to the disk-shaped end of seat 67. Consequently, seat 67 is urged upwards towards the rear of writing instrument 10. In one or more embodiments of the invention, the front surface of the disk-shaped end of seat 67 is adapted to flatly engage the untoothed end of elongated toothed stem 63. The back surface of the disk is adapted to engage an annular ridge 56 formed in the interior surface of tubular, elongated sleeve 50, such that the axial pressure exerted on the disk can be directly transferred to tubular, elongated sleeve 50 and, as a result, to actuator housing 5.

In using writing instrument 10, writing unit 3 is moved from its retracted position to a protracted position when the rear end of writing instrument 10 is depressed. Pressing the rear end of writing instrument 10 causes actuator housing 5 and tubular elongated sleeve 50 to move downwardly. The downward movement of actuator housing 5 can result in the activation of actuator unit 70 in addition to the protraction of writing unit 3, as further described below.

Tubular, elongated sleeve 50 is slidably engaged with the interior surface of lower tubular member 2. When actuator housing 5 moves downwards, so does actuator unit 70 housed therein. However, trigger 65 is engaged with the upper end of lower tubular member 2 by means of its prongs and therefore remains in a stationary position as elongated, tubular sleeve 50 moves downwards within the interior surface of lower tubular member 2. As a result, when actuator housing 5 is sufficiently displaced downwards, trigger 65 protrudes through opening 59 until its magnetic carbon layer 63 comes in contact with conductive plate 75.

When trigger 65 contacts conductive plate 75, actuator 70 is activated. Actuator 70, in addition to conductive plate 75, also includes one or more power sources and an integrated circuit that is wired to power illuminating unit 72 for a predetermined length of time. In one or more embodiments of the invention, illuminating unit 72 is a light emitting diode and actuator 70 is wired to keep illuminating unit 72 illuminated for approximately 20 seconds after activation, for example. In other embodiments of the invention, actuator 70 is wired so that illuminating unit 72 flashes on and off for a predetermined length of time after activation.

As indicated earlier, in addition to causing the illumination of illuminating unit 72, exertion of pressure to the rear end of writing instrument 10 can also result in the protraction or retraction of writing unit 3. When actuator housing 5 is pushed downwardly, annular ridge 56 formed on the lower internal surface of tubular elongated sleeve 50 pushes against the back surface of seat 67. As a result, seat 67 is axially displaced downwardly toward the front end of writing instrument 10. Seat 67, elongated toothed stem 63, lug member 61 and writing unit 3 are in an operational relationship with one another, as described earlier; therefore, the downward axial movement of seat 67 is respectively transferred along to elongated toothed stem 63, lug member 61 and writing unit 3.

In one or more embodiments of the invention, the engaging surfaces of elongated toothed stem 63 and lug member 61 are inclined such that lug member 61 is rotatably biased in a counterclockwise direction, for example, by the force of elongated toothed stem 63 in opposition to the biasing force of spring 42. In the retracted position, the lugs on the outer periphery of lug member 61 are longitudinally and slidably engaged in a first set of cam slots 21 formed on the interior surface of lower tubular member 2. The first set of cam slots 21 are sufficiently deep to allow for the biasing force of spring 42 to push writing tip 31 of writing unit 3 in a retracted position.

When downward pressure is applied to actuator housing 5, it displaces the lugs on the outer periphery of lug member 61 out of the first set of cam slots 21. Lug member 61, being rotatably biased and disengaged from cam slots 21, rotates due to the biasing force of spring 42 and longitudinally engages a second set of cam slots 21 when pressure is removed from the end of writing instrument 10. The second set of cam slots 21 are longitudinally shallower in comparison to the first set of cam slots 21. Therefore, when lug member 61 is engaged with the second set of cam slots 21, the extent to which biasing force of spring 42 can slidably push the writing tip 31 into the body of writing instrument 10 is limited by the shallow length of second cam slots 21. The longitudinal depth of second cam slots 21 is configured such that when lug member 61 is engaged with second cam slots 21, the writing tip 31 protrudes through the front opening of head member 1.

To reposition writing unit 3 in a retracted position, pressure can be applied to the end of writing instrument 10 This pressure forces lug member 61 out of the second set of cam slots 21. Once pressure is removed, lug member 61 is rotated due to the biasing force of spring 42, such that the lugs on the outer periphery of lug member 61 are engaged with the first set of cam slots 21. As explained earlier, the first set of cam slots 21 are sufficiently deep to allow for writing tip 31 to be retracted so that it is concealed within the body of the writing instrument 10.

One or more embodiments of the invention are adapted for use with a key chain accessory item. FIG. 5 is an exploded view illustrating the components of the illuminating mechanism adapted for use with a key chain unit, according to one or more embodiments of the invention. FIG. 6 is a cross-sectional view illustrating the components of the illuminating mechanism, as used in the key chain version of the invention. In this embodiment, actuator unit 70 is disposed in actuator housing 5 having top portion 53 and bottom portion 55. Top portion 53 includes a preferably circular opening that tightly receives ornamental cover 9.

Bottom portion 55 includes also a preferably circular opening 59 that allows for trigger 65 to access the conductive plate attached to the bottom of actuator 70. Bottom portion 55 includes attachment means, such as a threaded screw sleeve in combination with a screw, for tightly attaching actuator 70 to bottom portion 55 and an attachment ring for receiving a key chain. Trigger 65 includes a casing that is fitly engaged with circular opening 59. Trigger 65 is slidably mounted within the casing so that it can move upward to contact the conducting plate attached to the bottom of actuator 70, through opening 59. A cover 69 is fitly engaged with the casing of trigger 65 to prevent trigger 65 from being dislodged out of the casing.

Figure 7:
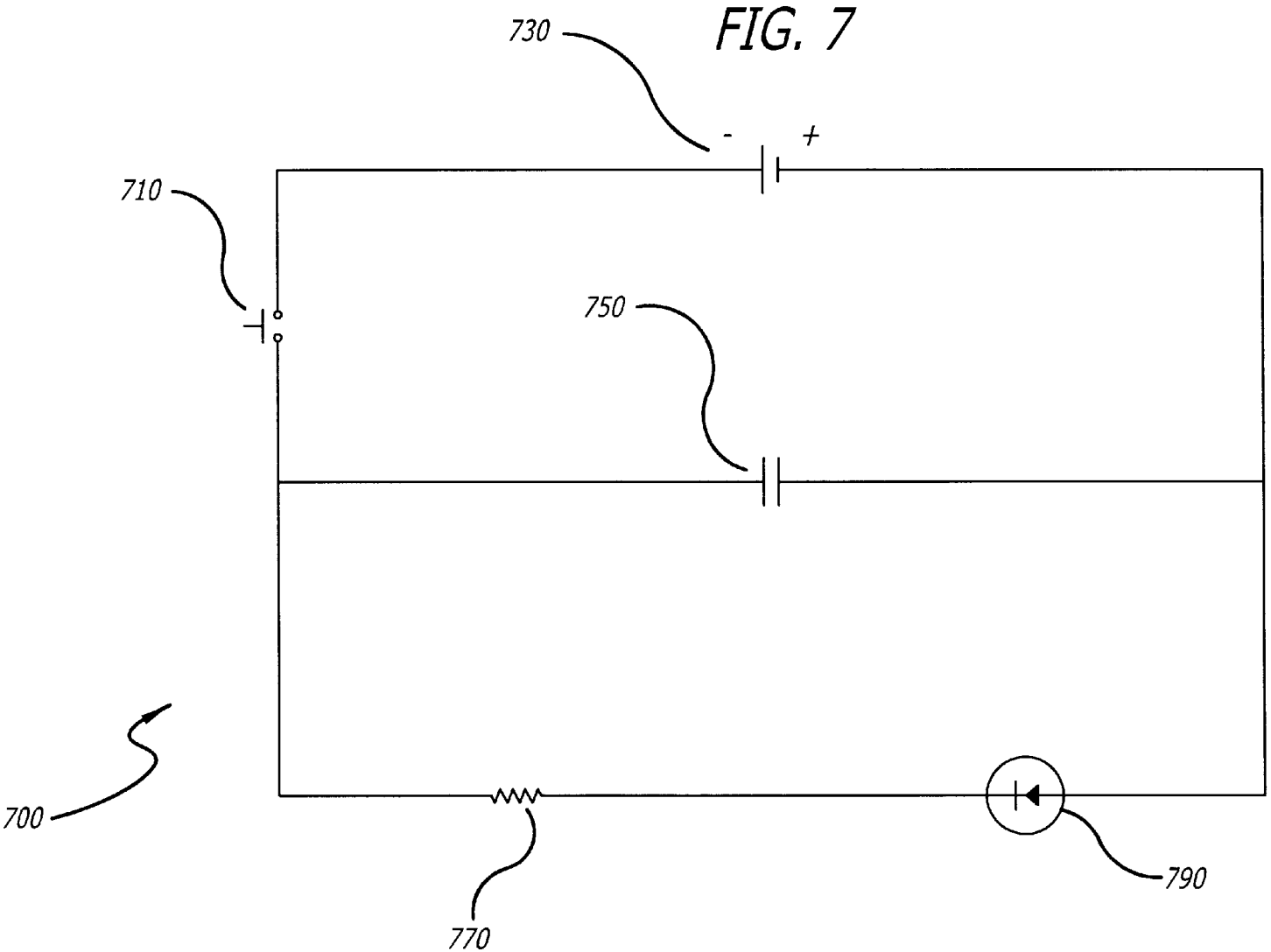
FIG. 7 is a schematic of the circuitry of the actuator unit, according to one or more embodiments of the invention.

FIG. 7 is a schematic of the circuitry of actuator unit 70, according to one or more embodiments of the invention. As illustrated in FIG. 7, circuit 700 includes a switch 710, at least one power source 730, a capacitor 750, preferably a resistor 770, and a light emitting diode 790. Diode 790 and resistor 770 are electrically connected in a serial combination. The serial combination is connected in parallel to capacitor 750 and power source 730. Trigger 65 and the conductive plate attached to the bottom of actuator 70 together act as a switch 710. Switch 710 is on when trigger 65 and the conductive plate are in contact. In an idle state, switch 710 is off (i.e., trigger 65 is not in contact with the conductive plate), therefore no electrical current is transferred to diode 790 from power source 730.

When trigger 65 comes into contact with the conductive plate a temporary closed circuit is established, during which electrical current is transferred from power source 730 to diode 790 and capacitor 750, thereby illuminating diode 790 and charging capacitor 750. When trigger 65 is no longer in contact with the conductive plate, an open circuit is established between power source 730 and capacitor 750, terminating capacitor 750's charging process. However, the capacitor 750 remains in a closed circuit with diode 790 and resistor 770 in a serial relationship. In this state, capacitor 790 is gradually discharged. Diode 790 remains illuminated so long as capacitor 790 maintains sufficient electrical charge.

In one or more embodiments of the invention, resistor 770 is included to control the rate at which capacitor 750 is discharged. As the flow of electricity in an electrical circuit is inversely related to the cumulate resistance of the components of the circuit, by varying the resistance of resistor 770 the flow of current with the circuit, and therefore the rate at which capacitor 70 is discharged may be controlled. As such, increase of resistance in the circuit will cause capacitor 750 to discharge at a slower rate and therefore diode 790 will remain illuminated for a longer time period. Conversely, reducing the cumulate resistance in the circuit, accelerate the rate at which the electrical charge stored in capacitor 750 discharges, and therefore diode 790 will remain illuminated for a shorter length of time.

Thus, an illuminable writing instrument and a key chain accessory according to one or more embodiments of the invention are described. While only a number of embodiments consistent with the present invention have been described, those skilled in the art will understand that various changes and modifications may be made to these embodiments, and equivalents may be substituted for elements in these embodiments, without departing from the true scope of the invention. For example, another embodiment of the invention may be directed to an illuminable refrigerator magnet.

In addition, modifications may be made to adapt a particular element, technique or implementation to the teachings of the present invention without departing from the central scope of the invention. Therefore, this invention should not be limited to the particular embodiments and methods disclosed in this application, but should include all embodiments that fall within the scope of the appended claims.

What is claimed is:

1. An illuminable writing instrument, comprising:

an elongated body having a front end and a rear end, said elongated body adapted to house an elongated writing unit having a writing tip, said front end of said elongated body having an opening adapted to receive said writing tip of said writing unit;

an illuminating unit attached to said rear end of said elongated body; and an actuator in operational relationship with said illuminating unit, said actuator causing said illuminating unit to flash on and off for a predetermined period of time before it automatically shuts off;

wherein said illuminating unit is illuminated when said actuator is activated.

2. The illuminable writing instrument of claim 1, wherein said actuator is push-activated.

3. The illuminable writing instrument of claim 1, wherein said actuator causes said illuminating unit to remain illuminated for a predetermined length of time.

4. The illuminable writing instrument of claim 1, wherein said actuator causes said illuminating unit to flash on and off for a predetermined amount of time.

5. The illuminable writing instrument of claim 1, wherein said writing unit includes a pencil lead.

6. The illuminable writing instrument of claim 1, wherein said writing unit further comprises an ink repository coupled to said writing tip.

7. The illuminable writing instrument of claim 1, wherein said elongated body further comprises a mechanism for causing said writing tip of said writing unit to protract or retract through said opening.

8. The illuminable writing instrument of claim 7, further comprising an ornamental cover with translucent or transparent segments, said ornamental cover containing said illuminating unit, wherein said illumination of said illuminating unit is visible through said translucent or transparent segments.

9. The illuminable writing instrument of claim 8, further comprising a trigger in operational relationship with said actuator, wherein exertion of pressure on a portion of said writing instrument causes said trigger to activate said actuator, and thereby illuminate said illuminating unit.

10. An illuminable key chain accessory, comprising:

an ornamental cover having translucent or transparent segments;

at least one illuminating unit disposed in said ornamental cover; and an actuator in operational relationship with said at least one illuminating unit;

wherein activation of said actuator causes said illuminating unit to illuminate for a predetermined length of time before it is automatically shutoff.

11. An illuminable pen, said pen comprising:

an elongated body with an ornamental cover having translucent or transparent segments, said elongated body having a writing tip at one end;

at least one illuminating unit disposed in said ornamental cover; and an actuator in operational relationship with said at least one illuminating unit;

wherein activation of said actuator causes said illuminating unit to illuminate for a predetermined length of time before it is automatically shutoff.

12. The illuminable key chain accessory of claim 10, wherein said actuator is push-activated.

13. The illuminable key chain accessory of claim 10, wherein said actuator causes said illuminating unit to remain illuminated for a predetermined length of time.

14. The illuminable key chain accessory of claim 10, wherein said actuator causes said illuminating unit to flash on and off for a predetermined amount of time.

15. The illuminable key chain accessory of claim 10, wherein said ornamental cover contains said illuminating unit, and said illumination of said illuminating unit is visible through said translucent or transparent segments of said ornamental cover.

16. The illuminable pen of claim 11, wherein said actuator is push-activated.

17. The illuminable pen of claim 11, wherein said actuator causes said illuminating unit to remain illuminated for a predetermined length of time.

18. The illuminable pen of claim 11, wherein said actuator causes said illuminating unit to flash on and off for a predetermined amount of time.

19. The illuminable pen of claim 11, wherein said ornamental cover contains said illuminating unit, and said illumination of said illuminating unit is visible through said translucent or transparent segments of said ornamental cover.

20. An illuminable writing instrument comprising:

an elongated body having a front end and a rear end, said elongated body adapted to house an elongated writing unit having a writing tip including a pencil lead, said front end of said elongated body having an opening adapted to receive said writing tip of said writing unit;

an illuminating unit attached to said rear end of said elongated body;

an actuator in operational relationship with said illuminating unit, said actuator causing said illuminating unit to flash on and off;

wherein said illuminating unit is illuminated when said actuator is activated.

* * * * *